United States Patent [19]

Brandau

[11] 4,037,753

[45] July 26, 1977

[54] CONTAINER CLOSURE, ESPECIALLY FOR MIXING CONTAINERS

[75] Inventor: Justus Brandau, Körle-E., Germany

[73] Assignee: Thyssen Industrie Aktiengesellschaft, Essen, Germany

[21] Appl. No.: 717,902

[22] Filed: Aug. 26, 1976

[30] Foreign Application Priority Data

Sept. 1, 1975 Germany ..... 2538768

[51] Int. Cl.[2] ..... B65D 43/20; B65D 55/00; F16K 51/00

[52] U.S. Cl. ..... 220/211; 220/345; 251/63.5; 251/144

[58] Field of Search ..... 220/211, 345, 346; 251/63.5, 144

[56] References Cited

U.S. PATENT DOCUMENTS

| | | | |
|---|---|---|---|
| 2,953,345 | 9/1960 | Slemmons et al. | 251/144 |
| 3,547,589 | 12/1970 | Rice et al. | 220/211 X |
| 3,563,508 | 2/1971 | DeLorenzo | 251/63.5 |
| 3,949,963 | 4/1976 | Aoki | 251/144 X |

*Primary Examiner*—Ro E. Hart

*Assistant Examiner*—Steven M. Pollard

*Attorney, Agent, or Firm*—Walter Becker

[57] ABSTRACT

A container closure, especially for mixing containers, which comprises a round closure dish, and a pressure medium operable cylinder-piston system connected to the discharge housing. The piston rod of the cylinder-piston system is operable to move the closure dish into and out of the opening of a container to be closed. In the cylindrical outer surface of the closure dish there is provided an annular groove having inserted therein a sealing element which in the closing position of the closure dish engages the guiding surface of the discharge opening in the wall of the container to be closed. The groove having the elastic sealing element arranged therein is defined on one hand by an annular end face of a pressure dish which is displaceable by a pressure medium on the piston rod of the closure dish and is operable to vary the width of the sealing element, and on the other hand the groove is defined by a circular step which is provided in the peripheral portion of the closure dish and faces the curved annular end face of the pressure dish.

4 Claims, 4 Drawing Figures

CONTAINER CLOSURE, ESPECIALLY FOR MIXING CONTAINERS

The present invention relates to a discharge closure for mixing containers which comprises a discharge housing connected to a mixing container, a round discharge dish or cover, a pressure fluid operable cylinder connected to said discharge housing the piston rod of which is operable to move the closure dish into and out of the discharge opening provided in the wall of the mixing container, and an elastic sealing element inserted in a circular groove provided in the cylindrical outer surface of the closure dish, said sealing element, when the discharge closure is in closing position, engaging the guiding surface of the discharge opening in the wall of the mixing container.

The outlet openings in mixing containers must during the mixing operation close so tightly that the mixing inner chamber can be subjected to a vacuum without the danger that air is drawn in through the discharge closure or between the discharge closure and the opening to be closed thereby.

With a heretofore known discharge closure, for purposes of sealing the discharge opening, an endless rubber ring or the like with circular cross section is inserted into the circular groove of the cylindrical outer surface of the closure dish. When the closure dish moves into the cylindrical discharge opening which customarily is provided with a slightly conical seating surface, the said ring is compressed in radial direction and deformed to an oval cross section. Such an arrangement has the drawback that the endless rubber ring may be damaged by shearing forces during the movement of the ring into the cylinder, and that particles of the material to be mixed deposit on the surface of the rubber ring thereby affecting the tightness of the discharge closure.

It is, therefore, an object of the present invention so to design a discharge closure to the above mentioned general type that damage to the elastic sealing element will be prevented and that the operational safety of the seal will be improved even if particles of the material to be mixed have accumulated within the sealing region.

These and other objects and advantages of the invention will appear more clearly from the following specification in connection with the accompanying drawings, in which.

The discharge closure according to the present invention is characterized primarily in that the groove for receiving the elastic sealing element is laterally confined and variable in width on one side by the vertical surface of a step extending around the outside and back side of the closure dish, and on the other side by the circular end face of a pressure dish which is adapted when subjected to a pressure medium to be displaced on the piston rod of the closure dish. In other words, the pressure dish and the piston adapted on either side thereof to be acted upon by pressure are fixedly mounted on a hollow piston rod and together are displaceable in longitudinal direction between the back side of the closure dish and the end face of the auxiliary piston on the inwardly located hollow piston rod.

In order that that surface of the closure dish which points to the interior of the container will be flush with the inner wall of the container, it is in conformity with a further development of the present invention, provided that the stroke of the closure dish in closing direction is confined by an abutment screw which is connected to the cylinder cover and extends into the inner chamber of the hollow inwardly located piston rod. The invention also provides that the sealing element consists primarily of an inwardly hollow ring of elastic material, for instance rubber or synthetic material.

Figure 1:
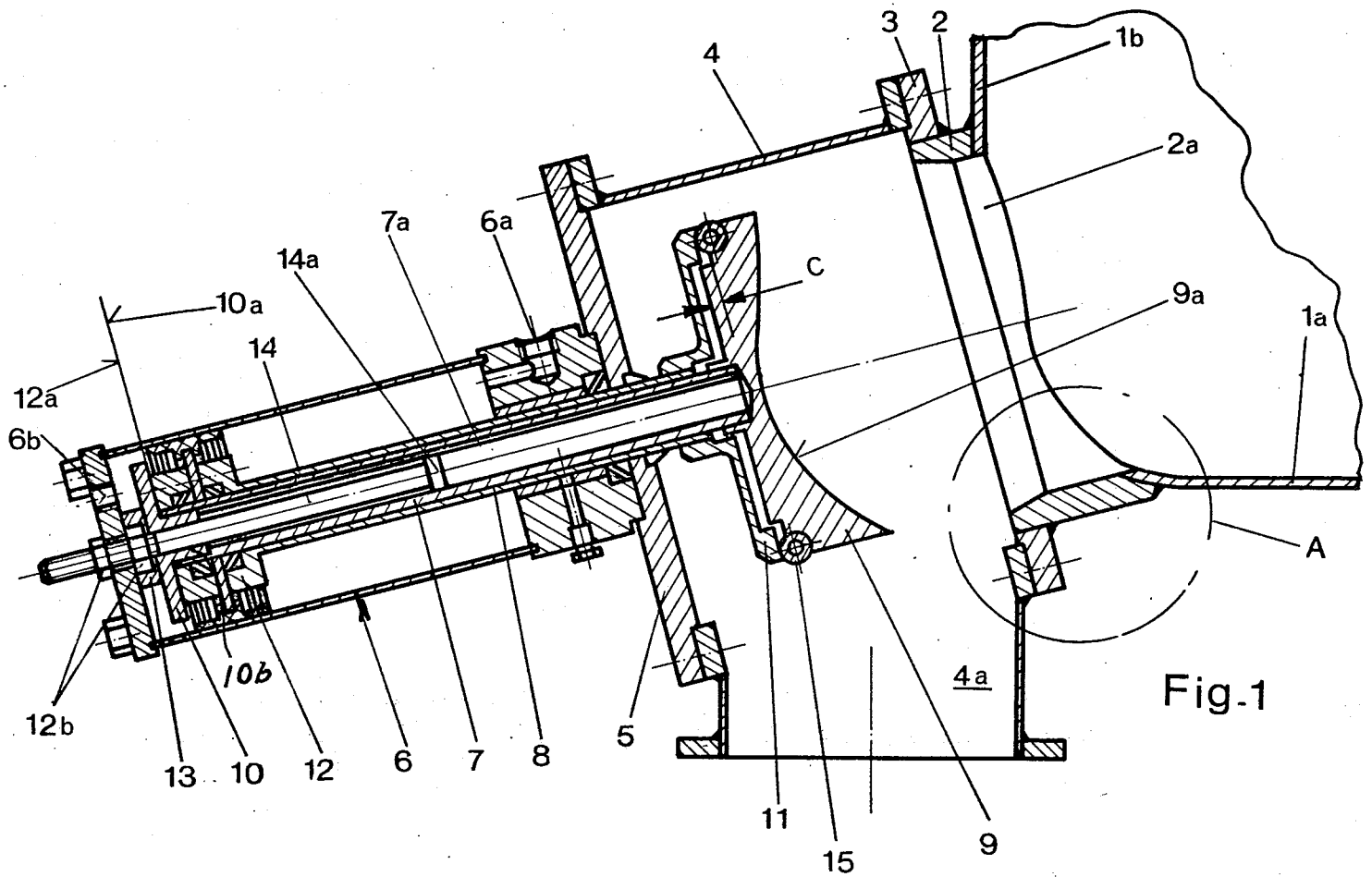
FIG. 1 represents a vertical section through a discharge closure according to the invention at a lower container rim of an upright container with the closure occupying its open position.
Figure 2:
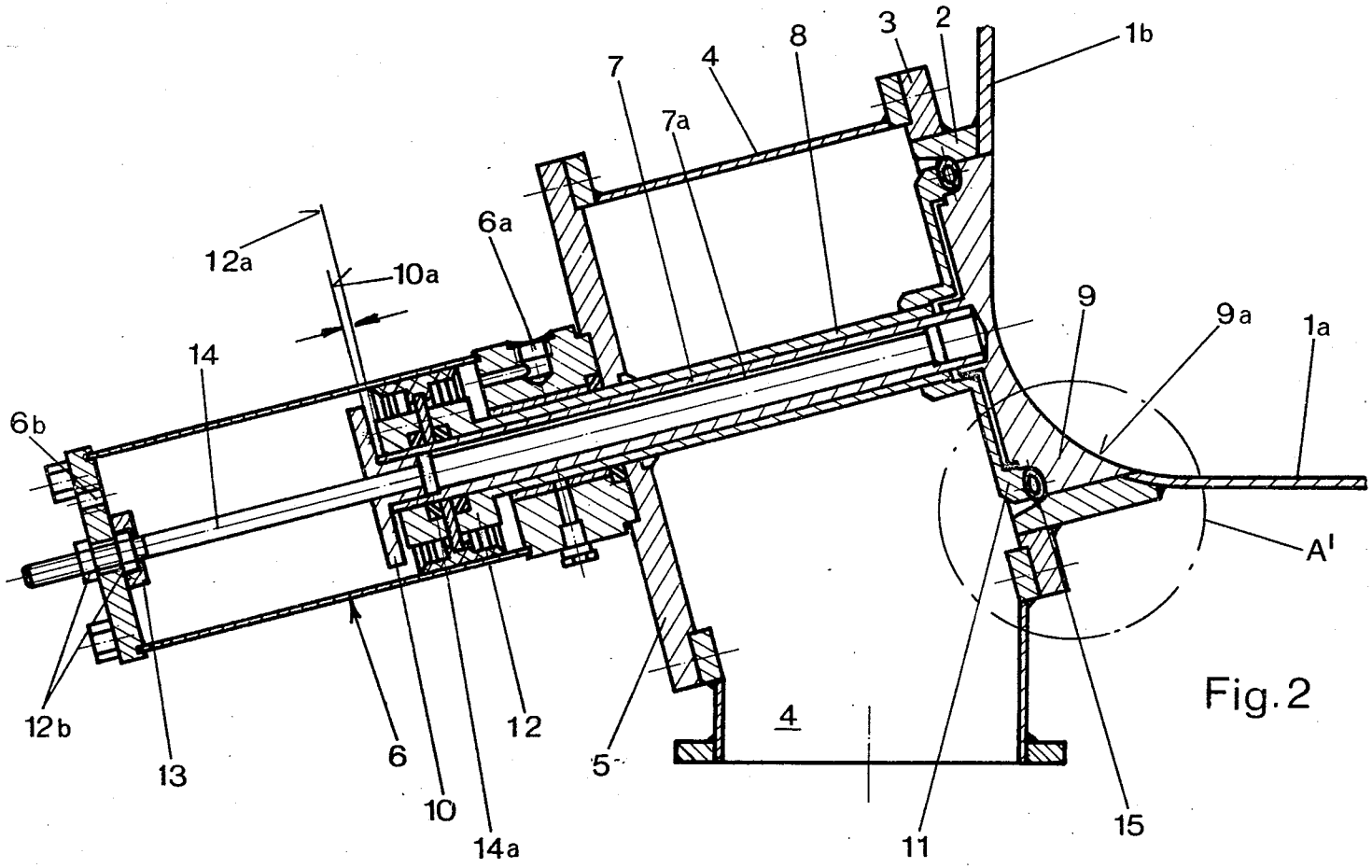
FIG. 2 shows the discharge closure according to FIG. 1 with the closing means in closing condition.

Referring now to the drawings in detail, it will be noted from FIG. 1 that in the rounded transition region between the bottom 1*a* and the cylindrical mantle 1*b* of the mixing container partly shown and in section, there is welded to said container a discharge connection 2 which at its free end is provided with a circular flange 3. Connected by means of screws to this flange 3 is a discharge housing 4 which is provided with a downwardly pointing discharge opening 4*a* and with a cover 5. A double-acting cylinder piston system 6 which is operable by air pressure is connected to the cover 5. The cylinder piston system 6 comprises two coaxially arranged hollow piston rods 7 and 8 of which the inwardly located hollow piston rod 7 is at the container side connected to a closure dish 9 and has its other end connected to an auxiliary piston 10. The outwardly located hollow piston rod 8 has that end thereof which is adjacent the container provided with a pressure dish 11 and at the opposite end forms a double-acting piston 12 which is sealingly guided on the inner wall of the cylinder 6.

In the opened position of the discharge closure as illustrated in FIG. 1, the auxiliary piston 10 the outer diameter of which is shorter than the inner diameter of cylinder 6 engages the abutment 13 which defines the end of the positive stroke of said auxiliary piston 10. In opened position of the discharge closure, the piston 12 with its surface 12*a* engages the surface 10*a* of the auxiliary piston 10. If now the cylinder 6 is at the connection 6*b* subjected to compressed air, piston 12 and auxiliary piston 10 engaging the surface 12*a* are at the same time moved in the direction toward the container to be closed while at the end of the common stroke, the closure dish 9 moves into the discharge opening 2*a.* The stroke of the inwardly located piston rod 7 which carries the closure dish 9, is limited by the head 14*a* of the abutment screw 14 which abuts the inwardly located collar 10*b* of the auxiliary piston 10. The immerging depths of the abutment screw 14 and thereby the closing stroke of the closure dish 9 are set by nuts 12*b* arranged at the cover of the cylinder 6.

In order to prevent an accidental turning of the closure dish 9 the front side 9*a* of which is designed in conformity with the inner wall contour of the mixing container within the region of the discharge opening, the inwardly located hollow piston rod 7 is on its inner side provided with a groove 7*a* extending in the longitudinal direction, into which groove by means of a nose the head 14*a* of the abutment screw 14 extends.

Figure 3:
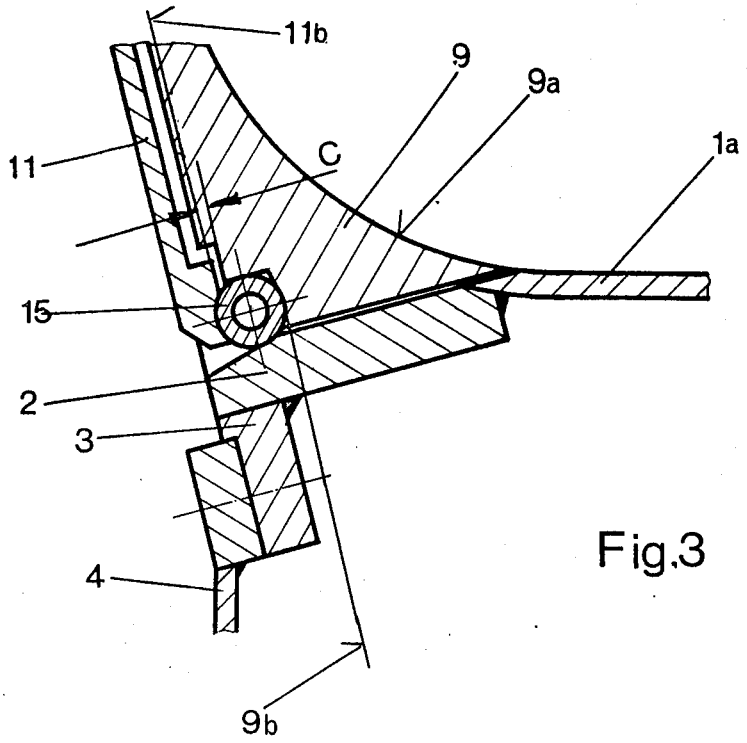
FIG. 3 illustrates that part of the discharge opening which is located within the dot-dash circle A of FIG. 1 while the closure dish has moved into the discharge opening but prior to the actual seating and sealing of the elastic seal.

In the position shown in FIG. 3, the closure dish 9 has reached its front end position. At this time, the sealing element 15 in the form of an inwardly hollow ring of elastic material for instance rubber or synthetic material rests on the back side of the closure dish 9 on a polygonal step but is not yet deformed and engages the outside of the slightly conical portion or seat of the discharge opening 2*a* without being subjected to any material pressure. The groove for receiving the sealing element 15 is laterally confined by the approximately vertical surface 9*b* of said step on the closure dish 9 and by the end face 11*a* of the pressure dish.

Figure 4:
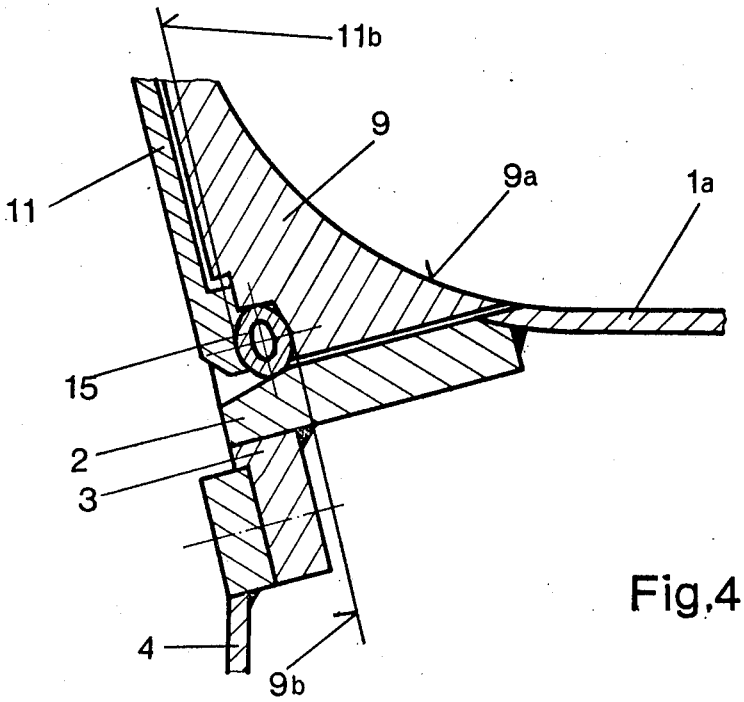
FIG. 4 shows that part of the discharge opening which is located within the dot-dash circle A' of FIG. 2 with the elastic seal deformed and in sealing position.

After, by engagement of the inwardly located collar 10*b* of the auxiliary piston 10 by the head 14*a* of the abutment screw 14, the closure dish 9 has reached its front end position according to FIG. 3, the piston 12 with the hollow piston rod and the pressure dish 11 connected thereto continues its movement by the distance C in closing direction until the pressure dish 11 abuts the backside of the closure dish 9. Thus, the groove for receiving the elastic sealing element 15 is decreased in width by the distance C shown in FIG. 3. As a result thereof, the said sealing element is deformed when the pressure dish 11 reaches its final end position, and consequently this sealing element is pressed at increased surface pressure against the conical part of the discharge opening 2*a* so that the discharge opening is properly sealed. In FIG. 4, the sealing element 15 is illustrated in deformed and sealing closing position.

For purposes of opening the discharge closure, the cylinder 6 is vented at the connected 6*b* and at the connection 6*a* is subjected to compressed air. As a result thereof, piston 12 first moves backwardly by a stroke equaling the distance C whereby the pressure dish 11 is lifted off the closure dish 9 and the elastic sealing element 19 is relieved and returns to its original shape. Subsequently, the piston 12 again engages the auxiliary piston 10 and moves the latter back to the abutment 13 whereby at the same time the closure dish 9 is moved out of the discharge opening 2*a* of the container.

As will be evident from the above, the great advantage realized by the present invention consists in that due to the closing movement of a single cylinder piston system, the closing movement of the closure dish and the sealing operation with the pressing-on of the sealing element occur directly one after another so that damage to the sealing element will be safely avoided.

It is, of course, to be understood that the present invention is, by no means, limited to the specific showing in the drawings, but also comprises any modifications within the scope of the appended claims.

What I claim is:

1. A closure for closing a container, which includes: a pressure medium operable cylinder piston system, comprising coaxially arranged first and second piston rod means, a substantially round closure dish connected to said first piston rod means and movable from an open position to a closing position for closing an opening of a container to be closed, a pressure dish having an annular end face and being connected to and movable by said second piston rod means toward and away from said closure dish, said closure dish having a peripheral step opposite said annular end face of said pressure dish, and an elastic sealing element arranged in said peripheral step for sealing engagement with the wall of an opening of a container to be closed when said closure dish is in its closing position, said annular end face of said pressure dish and said peripheral step of said closure dish when the said closure dish is in its closing position together defining a groove locating said sealing element.

2. A closure according to claim 1, in which said second piston rod means is hollow and surrounds said first piston rod means while being slidable relative thereto, and in which said pressure medium operable cylinder-piston system includes a double acting piston, said pressure dish and said double acting piston being fastened to said second piston rod means for selective displacement of said pressure dish in the longitudinal direction of said second piston rod means.

3. A closure according to claim 1, in which said first piston rod means comprises an axial bore, and which includes abutment means adjustably connected to that end of the cylinder of said cylinder-piston system which is farthest away from said closure dish, said abutment means extending into said first piston rod means, said cylinder piston system also including an auxiliary piston operable to move said closure dish into an opening of a container to be closed and to be stopped by engagement with said abutment means to thereby limit the closing stroke of said closure dish.

4. A closure according to claim 1, in which said sealing element is formed by a hollow ring of elastic material.

* * * * *